US011619466B2

(12) United States Patent
Jeung et al.

(10) Patent No.: US 11,619,466 B2
(45) Date of Patent: Apr. 4, 2023

(54) DOT SIGHT DEVICE

(71) Applicant: Bo Sun Jeung, Bucheon-si (KR)

(72) Inventors: Bo Sun Jeung, Bucheon-si (KR); Dong Hee Lee, Seongnam-si (KR)

(73) Assignee: Bo Sun Jeung, Bucheon-si (KR)

( * ) Notice: Subject to any disclaimer, the term of this patent is extended or adjusted under 35 U.S.C. 154(b) by 0 days.

(21) Appl. No.: 17/246,830

(22) Filed: May 3, 2021

(65) Prior Publication Data

US 2021/0341255 A1 Nov. 4, 2021

(51) Int. Cl.
*F41G 1/30* (2006.01)
*F41G 1/14* (2006.01)

(52) U.S. Cl.
CPC ..... *F41G 1/30* (2013.01); *F41G 1/14* (2013.01)

(58) Field of Classification Search
CPC ..... F41G 1/30; F41G 1/14
USPC ..... 42/113
See application file for complete search history.

(56) References Cited

U.S. PATENT DOCUMENTS

2015/0308788 A1* 10/2015 Jung ..... F41G 1/345 42/113
2019/0331461 A1* 10/2019 Zimmer ..... F41G 1/17
2021/0207928 A1* 7/2021 Brewer ..... F41G 1/16
2021/0270572 A1* 9/2021 Dawson, Jr. ..... F41G 11/001
2021/0341255 A1* 11/2021 Jeung ..... F41G 1/14
2022/0283440 A1* 9/2022 VanBecelaere .... G02B 27/0189

FOREIGN PATENT DOCUMENTS

GB 2292465 A * 2/1996 ..... G02B 23/105

* cited by examiner

*Primary Examiner* — Samir Abdosh
(74) *Attorney, Agent, or Firm* — Baker & McKenzie

(57) ABSTRACT

There is provided a dot sight device including a housing being configured to have an open front and an open rear, and a light path connecting a user with a target along a central axis of the light path disposed therein. A dot reticle generating unit generates a plurality of light rays for forming a dot reticle. A reflective mirror reflects the light rays provided from the dot reticle generating unit toward the user to form an image on a target side. A compensating plate is disposed along the light path of the housing together with the reflective mirror and passes through the light rays coming from the target to be directed toward the user. The compensating plate is configured to suppress or minimize one or more movements of the image of the target caused by one or more movements of the dot sight device.

28 Claims, 9 Drawing Sheets

DOT SIGHT DEVICE

CROSS-REFERENCE TO RELATED APPLICATIONS

This application claims priority to and the benefit of Korean Priority Patent Applications 10-2020-0053100, filed on May 4, 2020 and 10-2020-0172101, filed on Dec. 10, 2020, the entire contents of which are incorporated herein by reference.

BACKGROUND

The present invention relates to a dot sight device, and more specifically, to a dot sight device with a shake compensating plate capable of preventing, suppressing, or minimizing the shaking of a target image when the dot sight device is shaken.

For fast and accurate aiming, dot sight devices having a non-magnification or low-magnification lens with a dot reticle as illustrated in FIG. 1 and FIG. 2 have been proposed. These dot sight devices have advantages over the iron or mechanical sights which require the shooter to aim through the aim lining.

A dot sight device of a related art includes, as illustrated in FIG. 1, a barrel type housing 10 having a light path connecting a user and a target, a dot reticle generating unit 20 that is disposed in the barrel type housing 10 and provides dot reticle light rays, and a concave reflective mirror 30 that is disposed on the light path of the barrel type housing 10 and reflects the dot reticle light rays provided from the dot reticle generating unit 20 toward the user to provide a dot reticle image to the user, and protection windows are disposed in front and rear openings of the barrel type housing 10.

Further, a dot sight device of a related art includes, as illustrated in FIG. 2, an open type housing 10' having a light path connecting a user with a target, a dot reticle generating unit 20 that is disposed on the open type housing 10' and provides dot reticle light rays, and a concave reflective mirror 30 that is disposed on the light path of the open type housing 10' and reflects the dot reticle light rays provided from the dot reticle generating unit 20 toward the user to provide a dot reticle image to the user, and a protection window is disposed in a front opening of the open type housing 10'.

In this specification, when there is no need to distinguish the barrel type housing 10 and the open type housing 10', they are collectively referred to as a housing.

The optical-type non-magnification or low-magnification dot sight device described above allows simple and quick aiming which is especially useful in an urgent situation or for aiming and shooting close-range targets.

Compared to the traditional alignment method provided by iron or mechanical sights which require aligning of three points of a rear sight, a front sight, and a target, a dot sight allows easy securing of a field of view as aiming is performed by placing a dot reticle onto a target seen through the observation window 11 of the housing 10 or 10'. With a dot sight, it is possible to aim quickly and accurately, and it is also possible to secure the peripheral vision necessary for situation judgment.

Further, in the dot sight devices of the related arts, as illustrated in FIG. 3, the reflective mirror 30 includes a singlet or a doublet, and the front and rear surfaces of the singlet reflective mirror 30' or the front and rear surfaces of the doublet reflective mirror 30 are concave when viewed from the user's side. In this configuration, the surface of the lens constituting the reflective mirror is recognized as being concave toward the user.

In general, when a shooter using a dot sight aims at multiple targets in succession or when a shooter is on the move, for example, in a moving vehicle, the dot sight device may be shaken or wavered.

When the shaking of a dot sight device causes the reflective mirror 30 to rotate clockwise as illustrated in FIG. 4*a*, the image of the target seen through the aiming window 11 moves upward as illustrated in FIG. 4*b*, and when the shaking of a dot sight device causes the reflective mirror 30 to rotate counterclockwise as illustrated in FIG. 5*a*, the image of the target seen through the aiming window 11 moves downward as illustrated in FIG. 5*b*.

In addition, although not illustrated in the drawings, when the reflective mirror 30 rotates leftwards or rightwards, the image of the target seen through the aiming window 11 moves rightwards or leftwards as can be seen from FIGS. 4 and 5.

When the user is involved in a prolonged or multiple aiming or when the user is aiming at a target in a moving vehicle, the shaking of the dot sight device may cause fatigue in the user's eyes, such as asthenopia, to accumulate which may negatively affect the shooting efficiency of the user.

SUMMARY

The present invention was made to solve the foregoing problems, and it is an object of the present invention to provide a dot sight device with a shake compensating plate capable of improving the shooting efficiency and reducing the fatigue such as asthenopia of the user's eyes caused by the shakings of the dot sight device.

In addition, it is an object of the present invention to provide a dot sight device with a shake compensating plate capable of suppressing or minimizing the movement of the image of the target caused by the shakings of the dot sight device and preventing, suppressing, or minimizing the step difference phenomenon.

According to an embodiment of the present invention, the compensating plate capable of preventing, suppressing, or minimizing the shaking of the external field of view is disposed, together with the reflective mirror, on the light path between the user and the target, and, thus, it is possible to provide a dot sight device with a shake compensating plate capable of improving the shooting efficiency and the reducing the fatigue of the user's eyes such as asthenopia caused by the shakings of the dot sight device.

In addition, it is possible to provide a dot sight device with a shake compensating plate capable of preventing, suppressing, or minimizing the movement of the image of the target caused by the shakings of the dot sight device and preventing, suppressing, or minimizing the step difference phenomenon caused when a line connecting the center of the curvature of the front surface of the reflective mirror with a line connecting the center of the curvature of the rear surface is not parallel to the central axis of the light path of the housing.

DETAILED DESCRIPTION OF THE EMBODIMENT(S)

Figure 1:
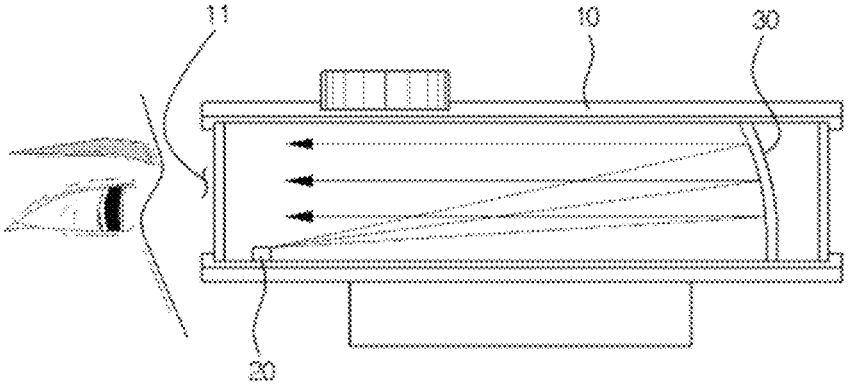
FIG. 1 is a diagram illustrating a configuration of a dot sight device of a related art.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Figure 7:
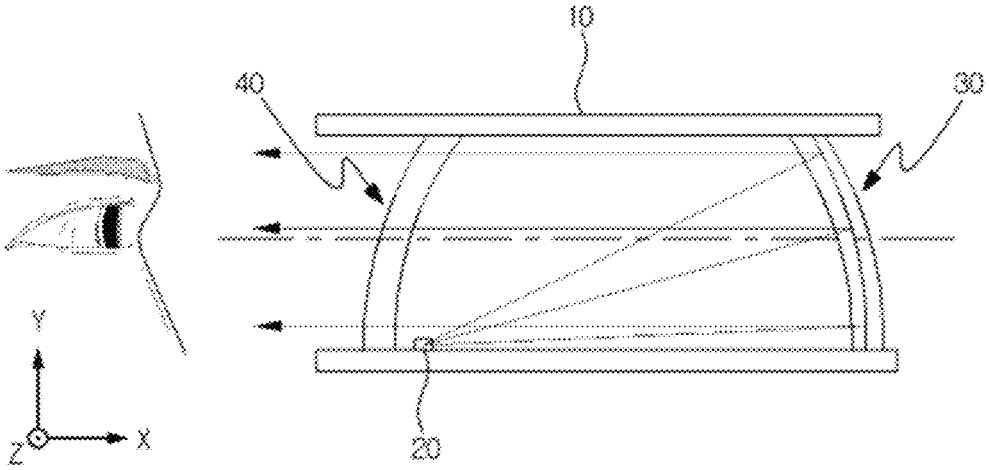
FIG. 7 is a block diagram of a dot sight device with a shake compensating plate according to an embodiment of the present invention.
Figure 8A:
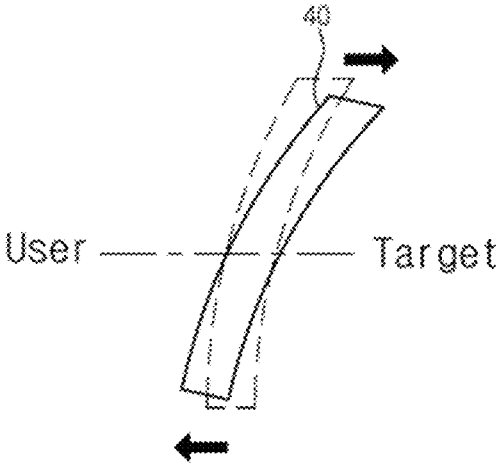
FIGS. 8*a*-8*b* are diagrams illustrating the characteristics of a compensating plate illustrated in FIG. 7.
Figure 8B:
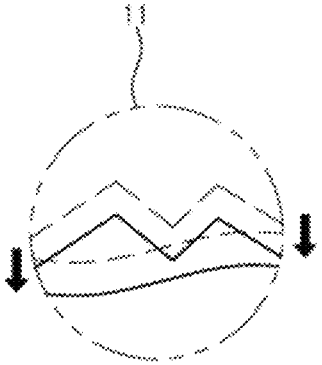
Figure 9:
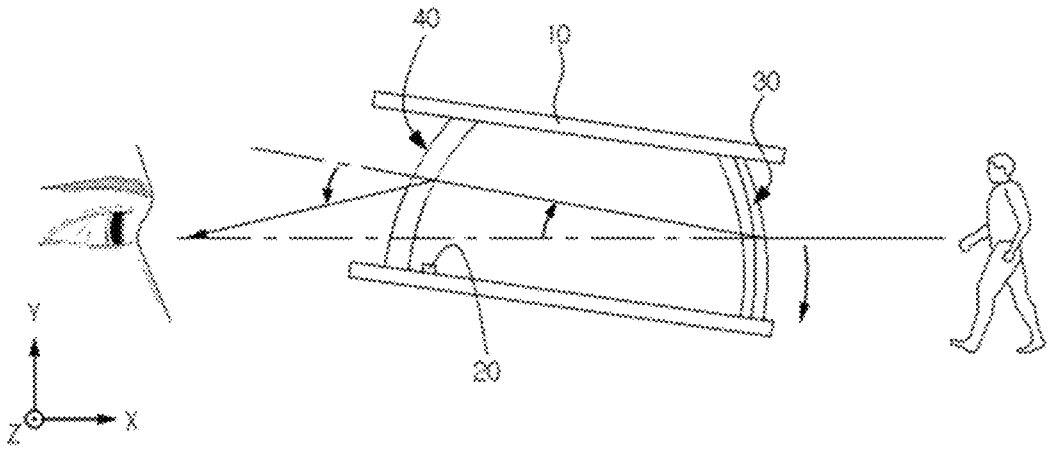
FIG. 9 is a diagram illustrating an operation of a dot sight device with a shake compensating plate according to an embodiment of the present invention.

FIG. 7 is a block diagram illustrating a dot sight device with a shake compensating plate according to an embodiment of the present invention, FIG. 8 is a diagram illustrating characteristics of a compensating plate illustrated in FIG. 7, FIG. 9 is a diagram illustrating an operation of a dot sight device with a shake compensating plate according to an embodiment of the present invention, and FIGS. 10 to 13 are block diagrams illustrating modified examples of a dot sight device with a shake compensating plate according to an embodiment of the present invention.

A dot sight device with a shake compensating plate according to an embodiment of the present invention includes a housing 10, a dot reticle generating unit 20, a reflective mirror 30, and a compensating plate 40.

The housing 10 has a cylindrical shape with an open front and an open rear, and a light path connecting the user with the target along the central axis of the light path disposed therein.

The housing 10 may include an observation window 11 through which the user can observe the target through the light path.

The dot reticle generating unit 20 serves to provide light rays required for forming the dot reticle and may include a light-emitting device such as an LED and a mask including a dot reticle-shaped light transmitting part positioned in front of the light-emitting device and may be fixed to one side of the inner circumferential surface of the housing 10.

An image forming element such as an OLED, an LCOS, or a micro-LED may be used as a means for providing the dot reticle light rays of the dot reticle generating unit 20.

The reflective mirror 30 reflects the dot reticle light rays provided from the dot reticle generating unit 20 toward the user to form an image on the target side in front of the user's eyes and transmits light rays coming from the target toward the user. The reflective mirror 30 may be a singlet or a doublet.

In a case in which the reflective mirror 30 is a doublet, a front surface facing the user and a rear surface facing the target are concave toward the user, and an interface surface located between the front surface and the rear surface may include an optical coating to reflect the dot reticle light rays toward the user.

The optical coating of the reflective surface is configured to reflect the dot reticle light rays emitted from the dot reticle generating unit 20 toward the user and transmit the light rays coming from the target.

It is desirable to design the radius of curvatures of the refractive surfaces through which the light rays on the light path from the target pass to the observer's eyes such that the ratio of the size of the image formed on the retina of the observer when viewed through the reflective mirror 30 and the size of the image formed on the retina when viewed with the naked eye is substantially 1:1.

To this end, it is known that the design condition of the reflective mirror 30 should satisfy Equation 1 or Equation 2 below.

$$|R3| = |R1| + t \quad \text{[Math. 1]}$$

$$D_1 = \frac{n-1}{R_1},\ D_2 = \frac{1-n}{R_3},\ D_1 + D_2 - \frac{t}{n}D_1D_2 = 0 \quad \text{[Math. 2]}$$

Here, D1 represents the refractive power of the front surface, D2 represents the refractive power of the rear surface, t represents the thickness of the reflective mirror, R1 represents the radius of curvature of the front surface, R3 represents the radius of curvature of the rear surface, and n represents the refractive index of the doublet reflective mirror glass.

In a case in which the reflective mirror 30 is a singlet, the front surface and the rear surface of the reflective mirror 30 are concave toward the user, and the front surface includes an optical coating to serve as a reflective surface that reflects the dot reticle light rays toward the user.

In a case in which the reflective mirror 30 is a singlet, it is preferable to design the lens such that there is substantially no magnification.

The compensating plate 40 is disposed on the light path of the housing 10 together with the reflective mirror 30 and passes through the light rays coming from the target to be directed toward the user. The front surface of the compensating plate 40 facing the user and the rear surface of the compensating plate 40 facing the target are convex when viewed from the user side. In this configuration, the surface of the lens constituting the compensating plate is recognized as being convex toward the user.

Further, it is preferable to set the radius of curvatures of the front surface and the rear surface of the compensating plate 40, the thickness between the centers of the curvatures of the front surface and the rear surface of the compensating plate 40 and the refractive power of the compensating plate 40 to be substantially equal to those of the reflective mirror 30.

Figure 10:
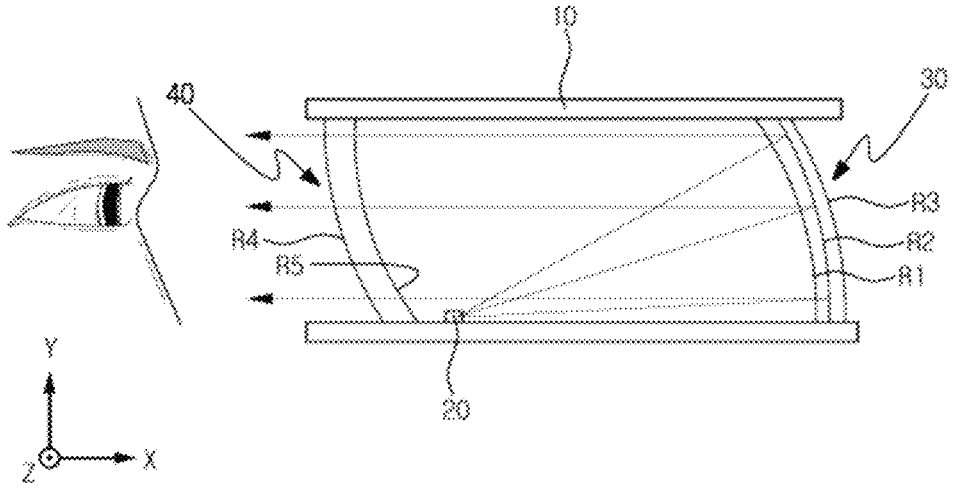
FIG. 10 is a block diagram illustrating a modified example of a dot sight device with a shake compensating plate according to an embodiment of the present invention.
Figure 11:
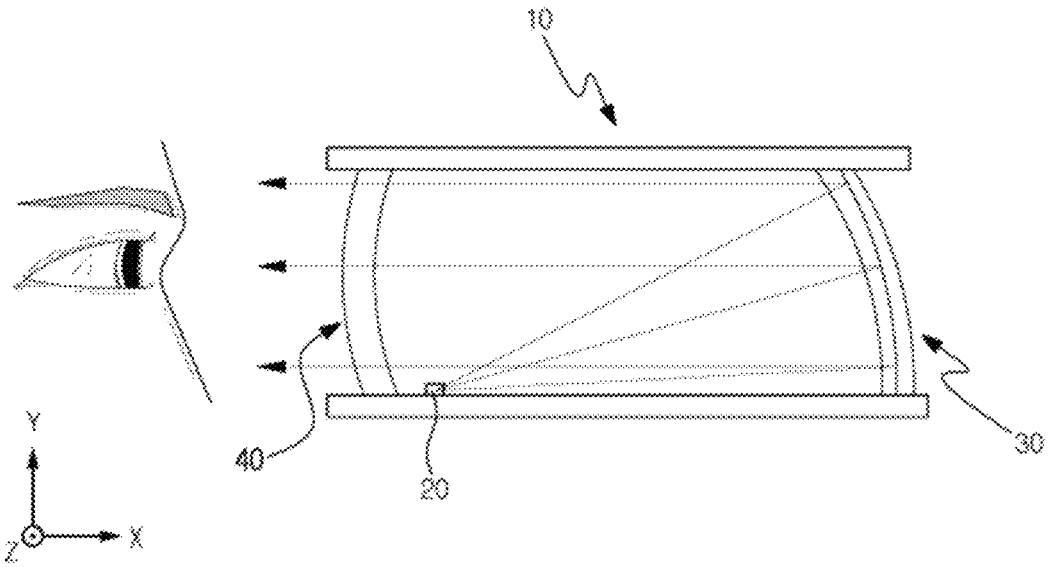
FIG. 11 is a block diagram illustrating a modified example of a dot sight device with a shake compensating plate according to an embodiment of the present invention.

In a case in which the optical axis of the reflective mirror 30 is at a slant with respect to the central axis of the light path of the housing 10: the compensating plate 40 may be disposed to be planar-symmetrical to the reflective mirror 30 based on a specific surface in a Y-axis direction that vertically intersects the central axis of the light path of the housing 10 as shown in FIG. 7; the compensating plate 40 may be disposed to be point-symmetrical based on a specific point on the central axis of the light path of the housing 10 as it is rotated 180 degrees as illustrated in FIG. 10; or, the compensating plate 40 may be disposed such that the optical axis of the compensating plate 40 is parallel to the central axis of the light path of the housing 10 as illustrated in FIG. 11.

In refractive characteristics of the compensating plate 40 having the above-described configuration, when the top and bottom sides of the transparent compensating plate 40 rotate clockwise as illustrated in FIG. 8*a*, the image of the target seen through the aiming window moves downward as illustrated in FIG. 8*b*.

Although not illustrated in the drawings, when the top and bottom sides of the compensating plate 40 rotate counterclockwise, the image of the target seen through the aiming window moves upward, and when the compensating plate 40 rotates leftwards or rightwards, the image of the target also move leftwards or rightwards.

Figure 5A:
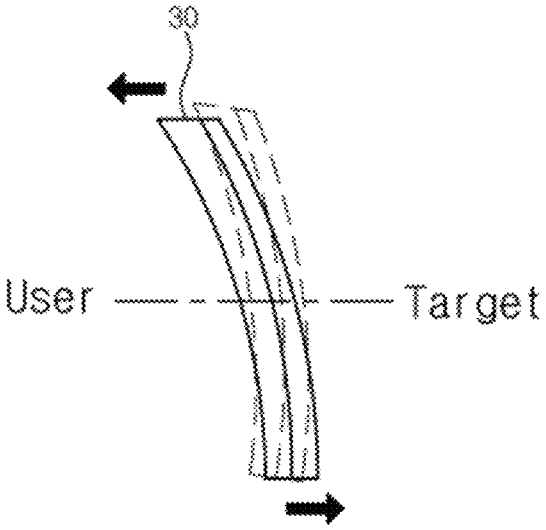
FIGS. 5*a*-5*b* are diagrams illustrating a problem of a dot sight device of a related art.
Figure 5B:
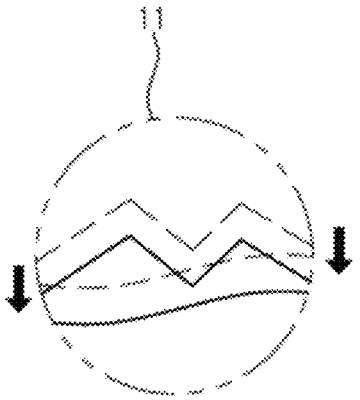

In a case in which the reflective mirror 30 is disposed alone in the housing 10 as in the related art, the image of the target seen through the aiming window moves due to the shake of the housing 10 as illustrated in FIG. 5. However, in a case in which the reflective mirror 30 and the compensating plate 40 are disposed together on the light path of the housing 10 as illustrated in FIG. 9, the direction in which the image of the target moves as the reflective mirror 30 is tilted and the direction in which the image of the target moves as the compensating plate 40 is tilted when the housing 10 is shaken are opposite to each other and, therefore, offset each other. As a result of this offset, the image of the target seen through the observation window 11 can be prevented, suppressed or minimized from shaking even when the dot sight device is shaken.

In a case in which the compensating plate 40 is disposed together with the reflective mirror 30 on the light path of the housing 10, the image of the target seen through the observation window 11 does not move even when the housing 10 is shaken, and, as a result, the fatigue accumulation of the user's eyes such as asthenopia can be suppressed or reduced.

Meanwhile, the example that the reflective mirror 30 is disposed at the target side end of the housing 10 and the compensating plate 40 is disposed at the user side end of the housing 10 has been described, but the present invention is not limited thereto.

For example, the compensating plate 40 may be disposed between the reflective mirror 30 and the target instead of between the reflective mirror 30 and the user. In this case, the length of the housing 10 increases, but it can also provide a compensation effect for the refraction of the reflective mirror 30 as described above.

FIG. 6 is a diagram for explaining a step difference phenomenon of the external field of view that occurs in a conventional dot sight device and illustrates a horizontal line near the target when the target is seen through observation window 11.

Figure 6A:
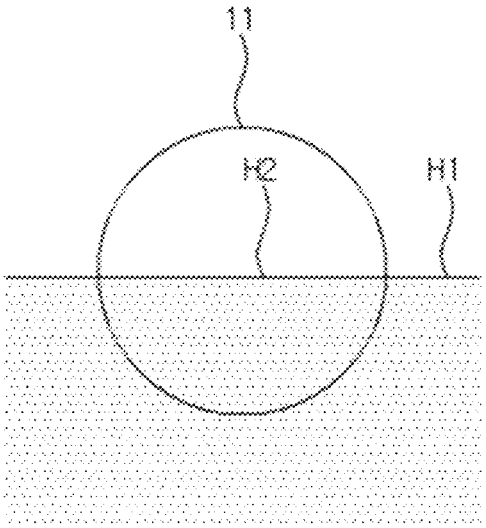
FIGS. 6*a*-6*c* are diagrams for explaining a step difference phenomenon of an external visual field occurring in a dot sight device of a related art.

If a horizontal line H1 near the target seen not through the observation window 11 and a horizontal line H2 near the target seen through the observation window 11 are connected as illustrated in FIG. 6*a*, it can be recognized that there is no step difference in the field of view of the observation window.

Figure 6B:
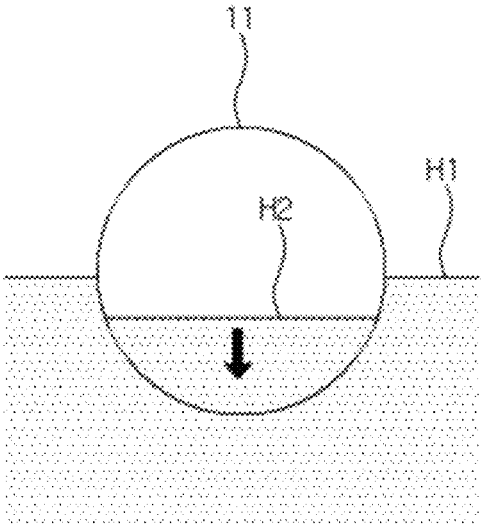

However, if the horizontal line H1 near the target seen not through the observation window 11 and the horizontal line H2 near the target seen through the observation window 11 are not connected as illustrated in FIG. 6*b*, it can be recognized that there is a difference in the field of view of the observation window.

This step-difference phenomenon may cause fatigue in the user's eyes such as asthenopia and may interfere with the concentration of the user when the user sees the field of view outside the observation window 11 and the field of view inside the observation window 11 with both eyes; that is, when the fields of view of both eyes are fused and become one. This step difference phenomenon is a factor that could have a negative effect on the user's shooting accuracy.

The step difference phenomenon generally occurs when a line connecting the center of the curvature of the front surface and the center of the curvature of the rear surface of the reflective mirror 30 is not parallel to the central axis of the light path of the housing 10.

Figure 6C:
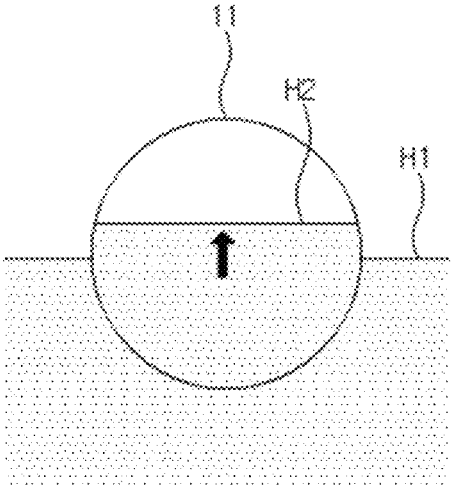

The step difference phenomenon illustrated in FIG. 6*b* occurs when the center of the curvature of the front surface of the reflective mirror 30 is lower than the center of the curvature at the rear surface thereof, and the step difference phenomenon illustrated in FIG. 6*c* occurs when the center of the curvature of the front surface of the reflective mirror 30 is higher than the center of the curvature at the rear surface thereof.

According to one embodiment, when the compensating plate 40 is disposed to be point-symmetrical to the reflective mirror 30 as it is rotated 180 degrees centering on a specific point on the central axis of the light path of the housing 10 in the Z-axis, the curved shapes of the compensating plate 40 and the reflective mirror 30 are opposite to each other. Thus, even when the housing 10 is shaken, the images of the target move in opposite directions in the concave reflective mirror 30 and in the convex compensating plate 40, their movements are offset, and as a result, the shakings of the target inside the observation window 11 can be prevented, suppressed or minimized.

Here, if a downward step difference occurs as illustrated in FIG. 6*b* because the line connecting the center of the curvature of the front surface of the reflective mirror 30 and the center of the curvature of the rear surface is not parallel to the central axis of the light path of the housing 10, the compensating plate 40 would cause an upward step difference as illustrated in FIG. 6*c*, and as a result, the step difference caused by the reflective mirror 30 is offset or canceled.

Meanwhile, the compensating plate 40 preferably has the same shape as the reflective mirror 30 to compensate for the step difference phenomenon caused by the reflective mirror 30 as described above.

In this regard, the radius of curvature R5 of the rear surface of the compensating plate 40 is, preferably, set to be equal to the radius of curvature R1 of the front surface of the reflective mirror 30 (|R1|=|R5|), the radius of curvature R4 of the front surface of the compensating plate 40 is, preferably, set to be equal to the radius of curvature R3 of the rear surface of the reflective mirror 30 ([R3|R4|], and the thickness of the compensating plate 40 is, preferably, set to be equal to that of the reflective mirror 30.

In a case in which the compensating plate 40 is disposed to be point-symmetrical to the reflective mirror 30 as it is rotated 180 degrees as described above, it is possible to compensate for the step difference phenomenon of the reflective mirror 30 and suppress the shake of the image of the target seen through the aiming window even when the housing 10 is shaken.

Meanwhile, in order to cause the target seen through the observation window 11 to have a magnification of 1 or no magnification, the radius of curvature R4 of the front surface and the radius of curvature R5 of the rear surface of the compensating plate 40 may be set to satisfy a relation of |R4|>|R5, and the radius of curvature R1 of the front surface and the radius of curvature R3 of the rear surface of the reflective mirror 30 may be set to satisfy a relation of |R1|<|R3|.

Although the present embodiment has been described in connection with the example in which the compensating plate 40 is a singlet because a reflective coating layer such as one found in the reflective mirror 30 as R2 surface (see FIG. 10) is unnecessary for the compensation plate 40, the compensating plate 40 may be a doublet as necessary, for example, to minimize parallax problem and for manufacturing convenience as well as cost-efficiency.

As an example of enhancing manufacturing efficiency, two sets of doublets having three surfaces having the radius of curvatures of the reflective mirror 30 can be made, and one doublet can be processed so that the R2 surface includes the reflective coating layer and can be used as the reflective mirror 30, and the other doublet can be processed so that the R2 surface does not include the reflective coating layer and can be used as the compensating plate 40. In this case, the manufacturing convenience and the cost efficiency can be enhanced than the case in which a doublet and a singlet are manufactured separately as the reflective mirror 30 and the compensating plate 40, respectively.

Although the present embodiment has been described in connection with the example of the dot sight device in which the housing 10 has a barrel shape, the shape of the housing 10 is not limited to the barrel shape.

Figure 2:
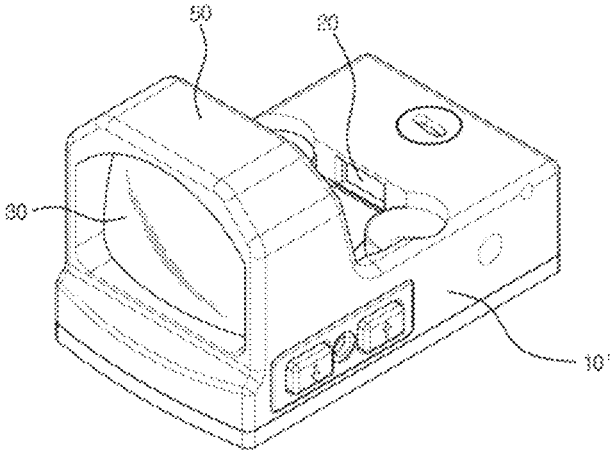
FIG. 2 is a diagram illustrating a configuration of a dot sight device of a related art.
Figure 3:
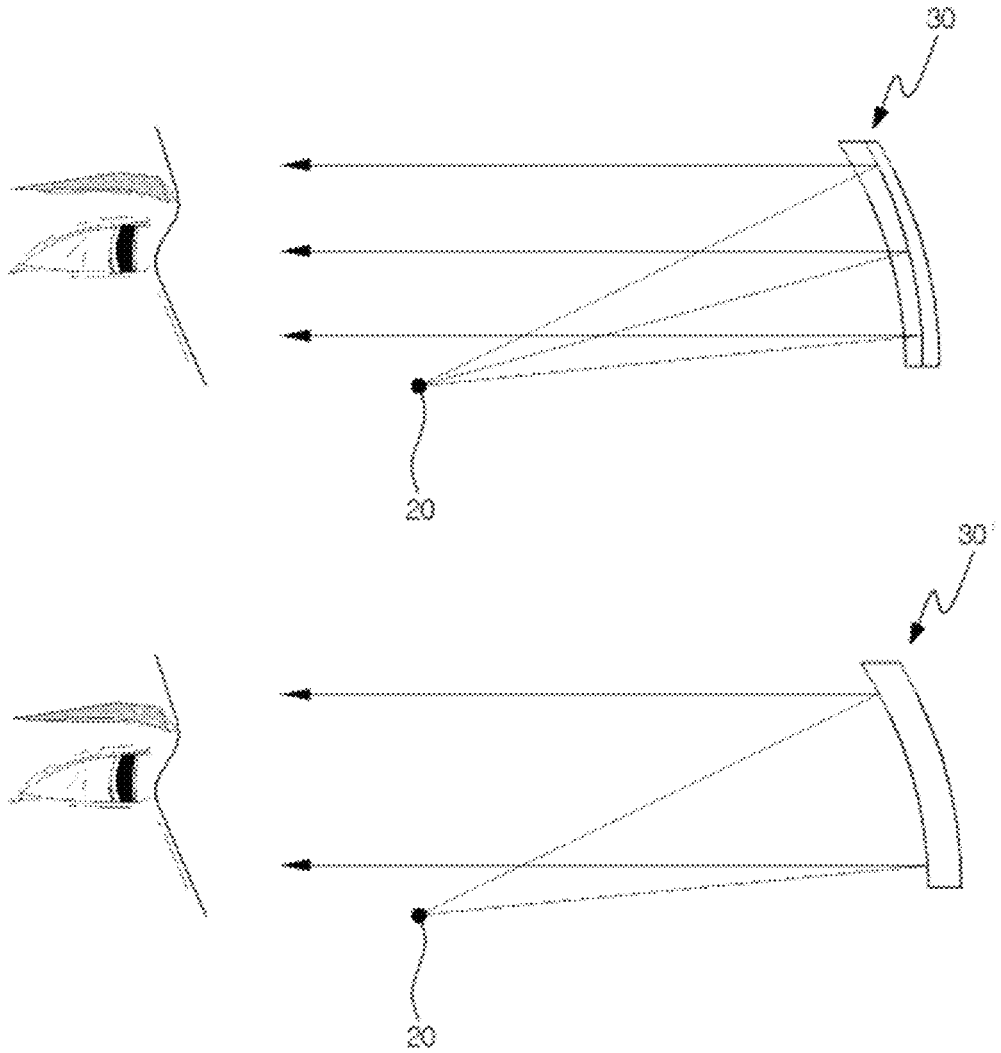
FIG. 3 is a configuration diagram of a reflective mirror of a dot sight device of a related art.
Figure 4A:
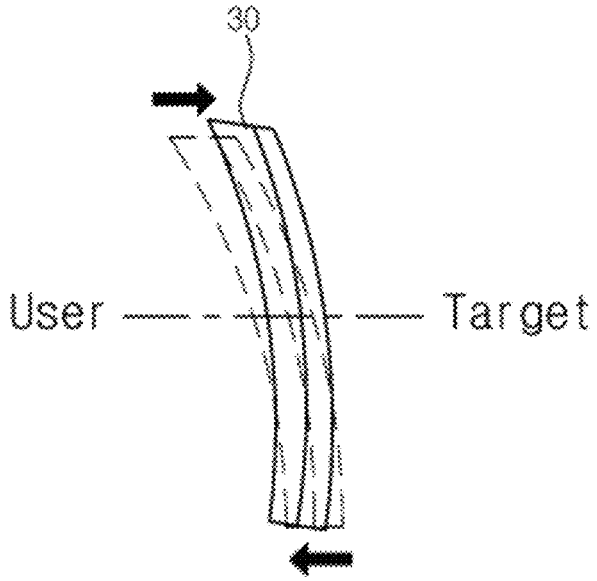
FIGS. 4*a*-4*b* are diagrams illustrating a problem of a dot sight device of a related art.
Figure 4B:
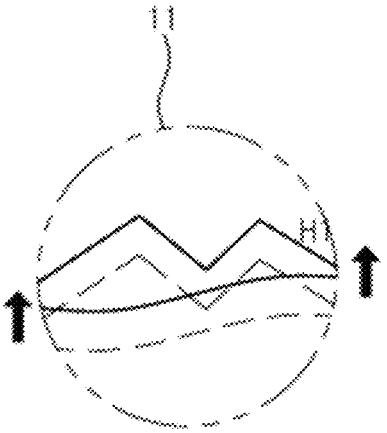
Figure 12:
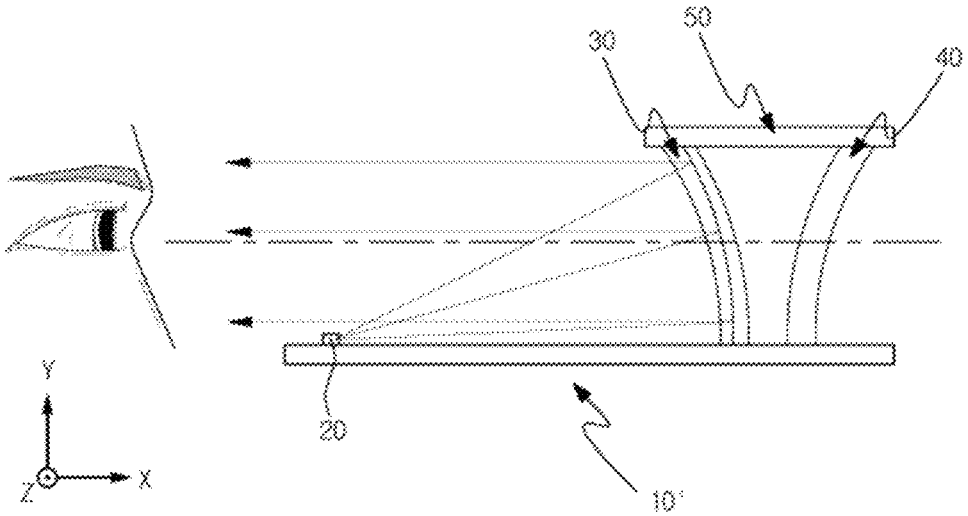
FIG. 12 is a block diagram illustrating a modified example of a dot sight device with a shake compensating plate according to an embodiment of the present invention.

The present invention can be applied to an open dot sight device including an open type housing 10' as illustrated in FIG. 2. For example, as illustrated in FIG. 12, an open type housing 10' includes a barrel part 50 surrounding a reflective mirror 30. The barrel part 50 should have sufficient length such that, a reflective mirror 30 having a concave shape toward the user and a compensating plate 40 having a convex shape toward the user can be disposed on the light path in the barrel part 50. Thus, it is also possible to prevent, suppress, or minimize the image of the target from moving due to the shakings of the open dot sight device.

Figure 13A:
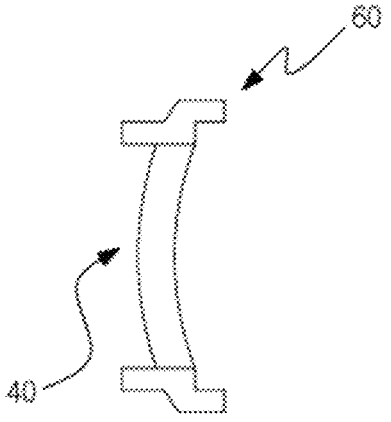
FIGS. 13*a*-13*c* are block diagrams illustrating a modified example of a dot sight device with a shake compensating plate according to an embodiment of the present invention.
Figure 13B:
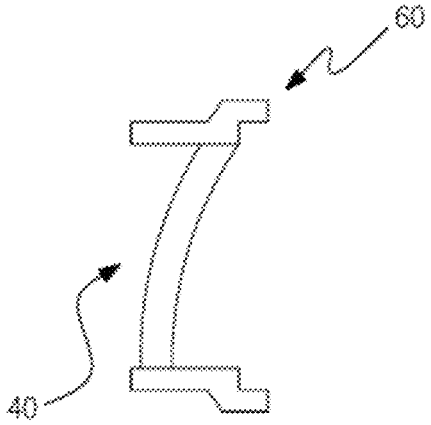

As an example, the compensating plate 40 may be configured to be detachably attached to the dot sight device as illustrated in FIGS. 13*a* and 13*b*.

The compensating plate 40 may include an adapter 60, and the compensating plate 40 can be detachably attached to the housing 10 through the adapter 60.

Preferably, the adapter should be configured to be assembled with the housing so that the compensating plate becomes symmetrical to the reflective mirror or the optical axis of the compensating plate is maintained to be parallel to the central axis of the light path of the housing.

Figure 13C:
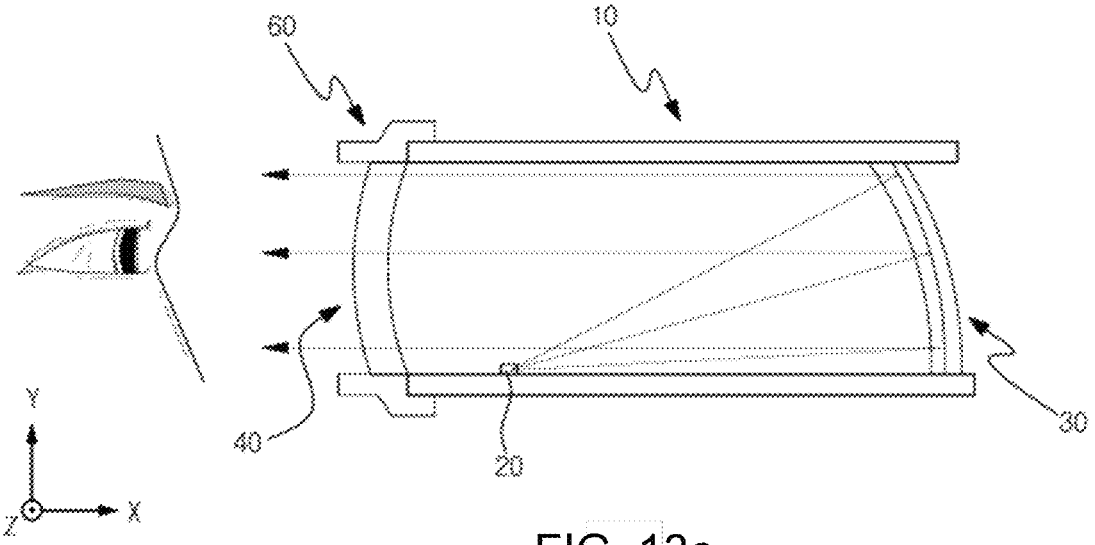

According to the present embodiment, the compensating plate 40 can be detachably attached to the housing 10 through the adapter 60 as illustrated in FIGS. 13*a* and 13*b* and can be assembled with the housing 10 of the conventional dot sight device having no compensating plate illustrated in FIG. 13*c*. Thus, it is possible to provide the compensation effect for the refraction of the reflective mirror 30 even in conventional dot sight devices.

Although the example in which the compensating plate 40 is disposed between the reflective mirror 30 and the user as illustrated in FIG. 13*c* has been described, the compensating plate 40 may be disposed between the reflective mirror 30 and the target.

The present invention is not limited to the above-described embodiments but may be implemented in various forms as in claims set forth below.

Although the present invention has been described in detail according to the embodiments, it is not limited to the above embodiments. It will be understood by those of ordinary skill in the art that the embodiments may be partially or totally combined with one another and various modifications of the embodiments may be made without departing from the scope of the subject matter of the present invention.

Further, the embodiments discussed have been presented by way of example only and not limitation. Thus, the breadth and scope of the invention(s) should not be limited by any of the above-described exemplary embodiments but should be defined only in accordance with the following claims and their equivalents. Moreover, the above advantages and features are provided in described embodiments, but shall not limit the application of the claims to processes and structures accomplishing any or all of the above advantages.

What is claimed is:

1. A dot sight device comprising:

a housing being configured to have an open front and an open rear, and a light path connecting a user with a target along a central axis of the light path disposed therein;

a dot reticle generating unit generating a plurality of light rays for forming a dot reticle;

a reflective mirror reflecting the light rays provided from the dot reticle generating unit toward the user to form an image on a target side; and a compensating plate disposed along the light path of the housing together with the reflective mirror and passes through the light rays coming from the target to be directed toward the user, wherein the compensating plate is configured to suppress or minimize one or more movements of the image of the target caused by one or more movements of the dot sight device.

2. The dot sight device of claim 1, wherein the reflective mirror comprises a front surface facing the user and a rear surface facing the target and the front surface and the rear surface are concave toward the user; and wherein the compensating plate comprises a front surface facing the user and a rear surface facing the target and the front surface and the rear surface are convex toward the user.

3. The dot sight device of claim 1, wherein the compensating plate is disposed planar-symmetrically to the reflective mirror.

4. The dot sight device of claim 1, wherein the compensating plate is disposed point-symmetrically to the reflective mirror.

5. The dot sight device of claim 1, wherein the compensating plate is disposed such that an optical axis of the compensating plate is parallel to the central axis of the light path of the housing.

6. The dot sight device of claim 1, wherein a radius of curvature and a thickness of a front surface and a rear surface of the compensating plate are substantially equal to a radius of curvature of a front surface and a rear surface of the reflective mirror.

7. The dot sight device of claim 1, wherein the reflective mirror is a singlet or a doublet lens.

8. The dot sight device of claim 1, wherein the compensating plate is a singlet or a doublet lens.

9. The dot sight device of claim 1, wherein the housing comprises a cylindrical shape.

10. The dot sight device of claim 1, wherein the reflective mirror is disposed nearer the target and the compensating plate is disposed nearer the user.

11. The dot sight device of claim 1, wherein the compensating plate is disposed between the reflective mirror and the target.

12. The dot sign device of claim 1, wherein the housing comprises an observation window through which the user observes the target through the light path.

13. The dot sight device of claim 1, wherein the compensating plate is configured to be detachably attached to the dot sight device.

14. The dot sight device of claim 13, wherein the compensating plate comprises one or more adapters configured to be assembled with the housing so that the compensating plate becomes symmetrical to the reflective mirror or an optical axis of the compensating plate is maintained to be parallel to a central axis of a light path of the housing.

15. The dot sight device of claim 1, wherein the reflective mirror comprises a front surface facing the user and a rear surface facing the target; and the compensating plate comprises a front surface facing the user and a rear surface facing the target, wherein radius of curvatures of the front and rear surfaces of the reflective mirror and the compensating plate are configured such that the ratio of the size of the image formed on the retina of the user when viewed through the reflective mirror and the size of the image formed on the retina when viewed with the naked eye is 1:1.

16. The dot sight device of claim 15, wherein the radius of curvatures of the front surface and the rear surface of the compensating plate, the thickness between centers of curvatures of the front surface and the rear surface of the compensating plate, and the refractive power of the compensating plate are configured to be equal to those of the reflective mirror.

17. A dot sight device comprising:

a housing being configured to have an open front and an open rear, and a light path connecting a user with a target along a central axis of the light path disposed therein;

a dot reticle generating unit generating a plurality of light rays required for forming a dot reticle;

a reflective mirror reflecting the light rays provided from the dot reticle generating unit toward the user to form an image on a target side;

a compensating plate disposed along the light path of the housing together with the reflective mirror and passes through the light rays coming from the target to be directed toward the user, wherein the compensating plate is configured to generate a step difference to suppress or minimize harmful effects to eyes caused when a line connecting a center of a curvature of a front surface of the reflective mirror and a center of a curvature of a rear surface of the reflective mirror is not parallel to the central axis of the light path of the housing.

18. The dot sight device of claim 17, wherein the reflective mirror is disposed nearer the target and the compensating plate is disposed nearer the user.

19. The dot sight device of claim 17, wherein the compensating plate is disposed between the reflective mirror and the target.

20. The dot sight device of claim 17, wherein the compensating plate is disposed to be point-symmetrical to the reflective mirror as it is rotated 180 degrees centering on a specific point on the central axis of the light path of the housing.

21. The dot sight device of claim 17, wherein the compensating plate is disposed to be planar-symmetrical to the reflective mirror.

22. The dot sight device of claim 17, wherein the compensating plate is disposed to be point-symmetrical to the reflective mirror as it is rotated 180 degrees centering on a specific point on the central axis of the light path of the housing.

23. The dot sight device of claim 17, wherein the compensating plate is disposed such that an optical axis of the compensating plate is parallel to the central axis of the light path of the housing.

24. The dot sight device of claim 17, wherein the reflective mirror and the compensating plate comprise curved shapes that are opposite each other.

25. The dot sight device of claim 17, wherein the reflective mirror and the compensating plate comprise the same shape as each other.

26. The dot sight device of claim 17, wherein the compensating plate generates the step difference that offsets movements produced by the reflective mirror to stabilize the target image.

27. The dot sight device of claim 17, wherein the compensating plate is a singlet or a doublet lens.

28. The dot sight device of claim 17, wherein the compensating plate is configured to be detachably attached to the dot sight device.

* * * * *